US008355859B2

(12) United States Patent
Maki et al.

(10) Patent No.: US 8,355,859 B2
(45) Date of Patent: Jan. 15, 2013

(54) ACCESSORY DRIVE FOR A STOP/START VEHICLE

(75) Inventors: Cliff Maki, New Hudson, MI (US); Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 134 days.

(21) Appl. No.: 12/917,889

(22) Filed: Nov. 2, 2010

(65) Prior Publication Data

US 2011/0174244 A1 Jul. 21, 2011

(51) Int. Cl.
*G06F 19/00* (2011.01)
*G06G 7/70* (2006.01)
*F02N 11/08* (2006.01)

(52) U.S. Cl. ..... 701/113; 123/179.3; 123/179.4

(58) Field of Classification Search ..... 123/179.4, 123/179.3, 198 C, 41.1, 41.44; 307/10.7; 701/101, 102, 112, 113
See application file for complete search history.

(56) References Cited

U.S. PATENT DOCUMENTS

| | | | | |
|---|---|---|---|---|
| 3,991,854 | A | 11/1976 | Tilley | |
| 4,328,669 | A | 5/1982 | Mort | |
| 4,332,302 | A | 6/1982 | Kosmanski | |
| 4,412,416 | A | 11/1983 | Van House | |
| 4,450,824 | A * | 5/1984 | Ando et al. | 123/568.22 |
| 4,491,094 | A | 1/1985 | Ogawa | |
| 4,759,316 | A * | 7/1988 | Itakura | 123/41.08 |
| 5,676,101 | A * | 10/1997 | Kawai et al. | 123/179.18 |
| 5,918,573 | A | 7/1999 | Killion | |
| 6,019,585 | A | 2/2000 | Abelen et al. | |
| 6,079,629 | A | 6/2000 | Morikawa et al. | |
| 6,343,572 | B1 | 2/2002 | Pfaff et al. | |
| 7,086,366 | B1 | 8/2006 | Killion | |
| 7,391,129 | B2 * | 6/2008 | Chiao et al. | 307/9.1 |
| 7,520,734 | B2 | 4/2009 | Luedtke et al. | |
| 7,674,096 | B2 | 3/2010 | Sundheim | |
| 2002/0174653 | A1 | 11/2002 | Uzkan | |
| 2003/0131806 | A1 * | 7/2003 | Suzuki et al. | 123/41.14 |
| 2003/0172891 | A1 | 9/2003 | Suzuki | |
| 2009/0139472 | A1 * | 6/2009 | Gehres et al. | 123/41.08 |

FOREIGN PATENT DOCUMENTS

DE 4107049 A1 9/1992

OTHER PUBLICATIONS

Pursifull, Ross Dykstra, "Efficient Vacuum for a Vehicle," U.S. Appl. No. 12/917,862, filed Nov. 2, 2010, 30 pages.

* cited by examiner

*Primary Examiner* — Stephen K Cronin
*Assistant Examiner* — Raza Najmuddin
(74) *Attorney, Agent, or Firm* — Julie Voutyras; Alleman Hall McCoy Russell & Tuttle LLP

(57) ABSTRACT

An engine with vacuum and coolant pumps is disclosed. In one example, the vacuum and coolant pumps are mechanically coupled together and driven by a single motor. The approach may reduce system cost and complexity.

14 Claims, 3 Drawing Sheets

ACCESSORY DRIVE FOR A STOP/START VEHICLE

BACKGROUND/SUMMARY

Start/stop vehicles may be frequently automatically stopped by a controller in response to operating conditions to conserve fuel. For example, an engine of a stop/start vehicle may be stopped in response to a vehicle stop after the engine has reached a predetermined temperature. However, if there is an absence or a low level of vacuum for vehicle brakes or other systems, the automatic stop may be delayed until a desired level of vacuum is achieved. Consequently, less fuel may be saved since the vehicle continues to operate until a desired level of vacuum is provided.

Stop/start vehicles may also have unique circumstances related to engine cooling and frequent engine stops and starts. In particular, if an engine is at operating temperature and is then stopped, engine temperature may increase since coolant may not be pumped from the engine to the cooling system without engine rotation. Further, if the engine is started and stopped at frequent intervals, more engine heat may be retained instead of being rejected to a radiator or heater core since the engine may have less opportunity to pump coolant from the engine.

Thus, automatic engine starting and stopping can increase fuel economy when operating conditions permit engine stopping; however, operation of vehicle accessories (e.g., vacuum pumps, coolant pumps, and alternators) may limit opportunities to stop the engine since stopping the engine may interfere with operation of the accessories.

The inventors herein have recognized the above-mentioned disadvantages and have developed an engine accessory drive system, comprising: an engine; a vacuum pump; a coolant pump configured to supply liquid coolant to the engine; and an electrically driven motor coupled to the vacuum pump and the coolant pump.

By coupling a vacuum pump and a coolant pump to an electrically driven motor it may be possible to increase vehicle fuel economy since the engine may not be required to continue operating for the sole purpose of producing vacuum or reducing engine heat. In addition, since it may be desirable to selectively operate a vacuum pump and coolant pump in the absence of engine rotation, system cost and complexity can be reduced by coupling a single electric motor to the vacuum pump and the coolant pump.

In addition, accessory pumps (e.g., engine coolant pump, fuel pumps, transmission pumps, vacuum pumps, and air conditioning pumps) account for a high percentage of parasitic engine load. The inventors herein have recognized that the parasitic losses of these pumps can be reduced by operating the pumps on an as needed basis and by operating the pumps at efficient operating conditions.

The present description may provide several advantages. In particular, the approach can increase vehicle fuel economy since the engine can be stopped without affecting the production of vacuum or coolant flow. In addition, the approach can reduce system cost since a vacuum pump and coolant pump can be driven by a single electric motor rather than by two separate motors. Further, the speed of the motor may be adjusted to account for different priorities between the coolant pump and the vacuum pump.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
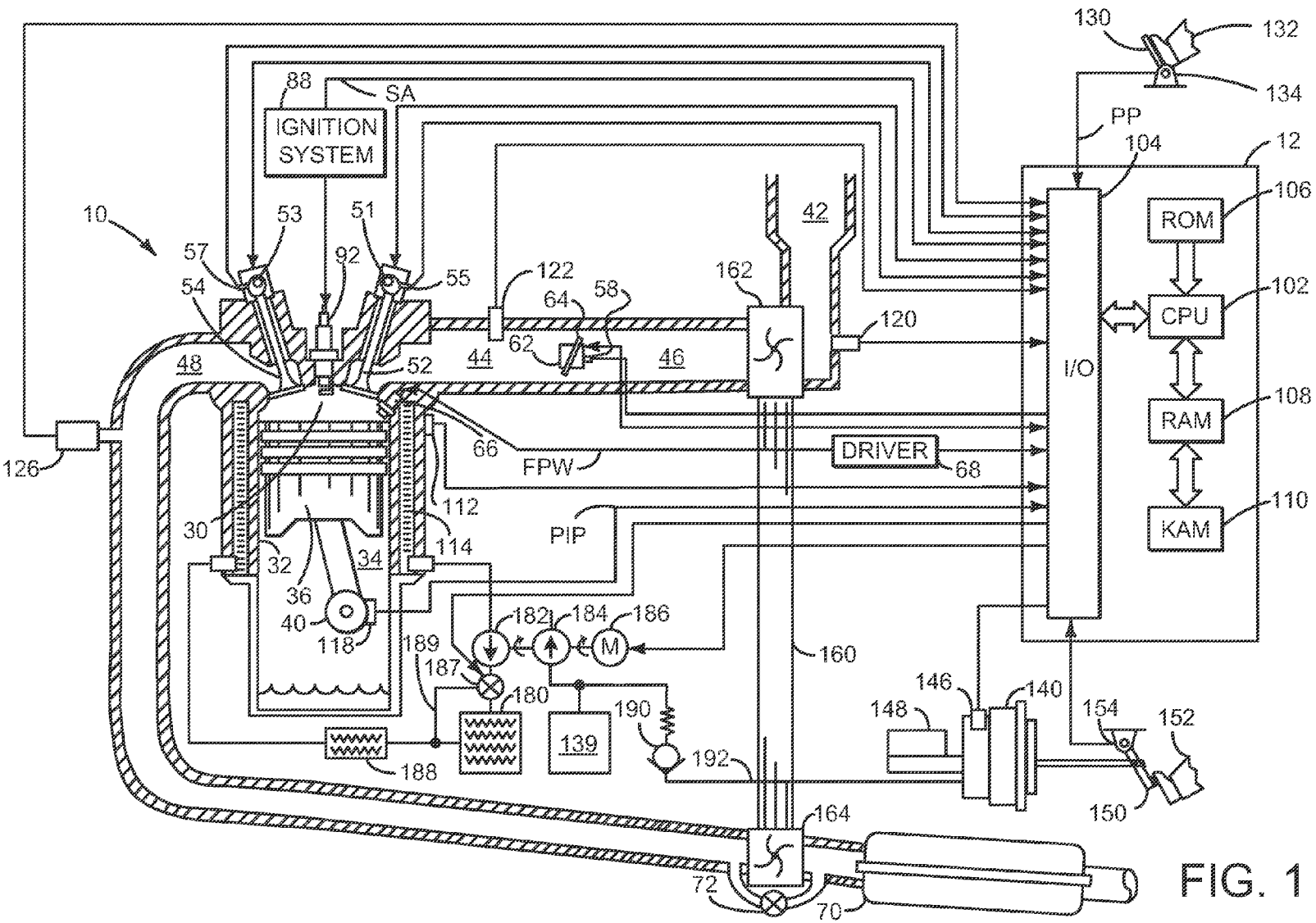
FIG. 1 shows a schematic depiction of an engine.
Figure 2:
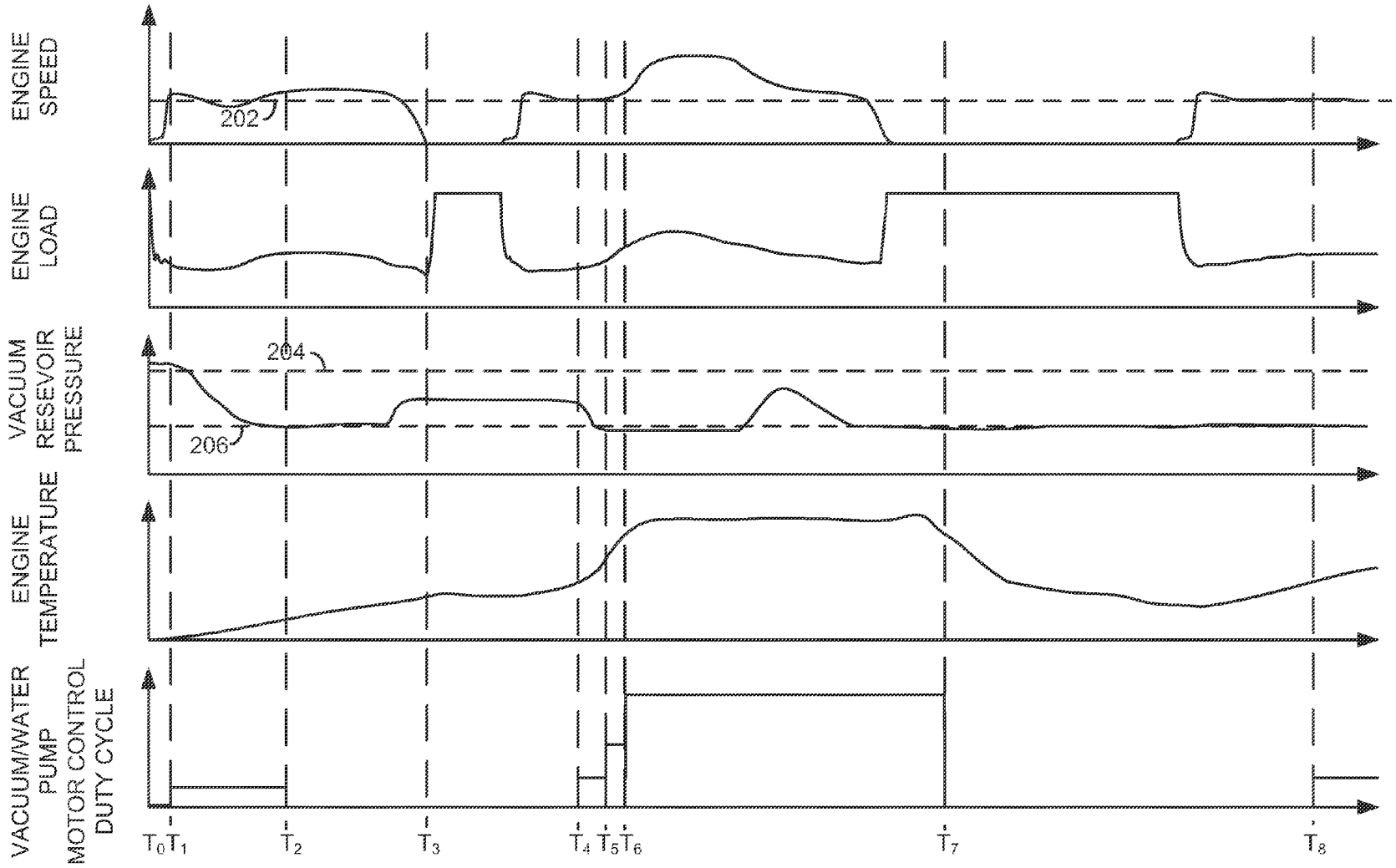
FIG. 2 shows simulated signals of interest during engine operation.

The present description is related to producing vacuum and circulating engine coolant for a vehicle. FIG. 1 shows one example system for producing vacuum and circulating engine coolant via an electrically driven motor. FIG. 2 shows simulated signals of interest when controlling vacuum and engine coolant circulation according to the method of FIG. 3.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail (not shown). Fuel injector 66 is supplied operating current from driver 68 which responds to controller 12. In addition, intake manifold 44 is shown communicating with optional electronic throttle 62 which adjusts a position of throttle plate 64 to control air flow from intake boost chamber 46 to intake manifold 44.

Compressor 162 draws air from air intake 42 to supply boost chamber 46. Exhaust gases spin turbine 164 which is coupled to compressor 162 via shaft 160. Vacuum operated waste gate actuator 72 allows exhaust gases to bypass turbine 164 so that boost pressure can be controlled under varying operating conditions. Vacuum is supplied to waste gate actuator 72 via vacuum reservoir 139 by way of a conduit (not shown).

Electrically driven motor 186 is command by controller 12. In one example, controller outputs a pulse width modulated signal to control the speed of electrically driven motor 186. Electrically driven motor 186 is coupled to vacuum pump 184 and coolant pump 182. In one example, electrically driven motor 186 is coupled to vacuum pump 184 and coolant pump 182 via a single or sole drive shaft. In this example, electrically driven motor 186 drives vacuum pump via a beltless mechanical coupling. However, in other examples, a belt or other device may couple the motor to the vacuum and coolant pumps. Further, the system may included clutches (not shown) between coolant pump 182, electrically driven motor 186, and vacuum pump 184 such that electrically driven motor 186 may operate coolant pump 182 without operating vacuum pump 184 and vice-versa.

Coolant pump 182 is in fluid communication with cooling jacket 114 for circulating coolant through engine 10. Coolant pump 182 is configured to direct coolant thorough radiator 180 and heater core 188. Heater core 188 provides heat to the vehicle cabin (not shown). Valve 187 allows coolant to flow from coolant pump 182 through radiator 180 and limits coolant flow from bypassing radiator 180 through conduit 189 when in a first position. Valve 187 bypasses radiator 180 via conduit 189 and limits coolant flow from coolant pump 182 to radiator 180 when in a second position. In one example, controller 12 adjusts the position of valve 187. In other examples, valve 187 changes state in response to coolant temperature. In this way, coolant from coolant pump 182 can be directed through radiator 180 and heater core 188.

Vacuum pump 184 provides vacuum to brake booster 140 via conduit 192. Check valve 190 limits air flow only from vacuum pump 184 to brake booster 140. Additional vacuum storage capacity is provided by vacuum reservoir 139. Brake booster 140 includes an internal vacuum reservoir and it amplifies force provided by foot 152 via brake pedal 150 to master cylinder 148 for applying vehicle brakes (not shown).

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine temperature (ECT) from temperature sensor 112 coupled to cooling sleeve 114; a position sensor 134 coupled to an accelerator pedal 130 for sensing accelerator position adjusted by foot 132; a position sensor 154 coupled to brake pedal 150 for sensing brake pedal position, a pressure sensor 146 for sensing brake booster vacuum; a knock sensor for determining ignition of end gases (not shown); a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some embodiments, the engine may be coupled to an electric motor/battery system in a hybrid vehicle. The hybrid vehicle may have a parallel configuration, series configuration, or variation or combinations thereof. Further, in some embodiments, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples.

In some examples the vacuum pump may be an electrically driven vacuum pump that is lubricated (e.g., vacuum pump seals and moving parts) by oil from the engine crankcase. Further, the vacuum pump may exhaust pumped air to the engine crankcase or another sealed engine region (e.g., under cylinder head valve covers). In this way, the efficiency of the electrically driven pump can be increased because of improved vacuum pump sealing. The system may also include a mechanically engine driven coolant pump that provides a base level of coolant pumping and an auxiliary electrically driven coolant pump that provides coolant a high engine loads. The auxiliary electrically driven coolant pump may handle coolant pumping for all cooling circuits. Alternatively, the auxiliary electrically driven coolant pump may handle coolant for one or more circuits such as coolant circulation within the engine, coolant circulation within the radiator, or coolant circulation through the heater core to provide cabin heat. Thus, the auxiliary electrically driven coolant pump's function can be apportioned by magnitude and coolant circuit.

In still other examples, the vacuum pump and the coolant pump may be selectively driven by the engine or by the electric motor. Clutches may be activated and deactivated to allow the electric motor or engine to drive the vacuum and coolant pump. In still another example, the engine may drive the coolant pump while the electric motor drives the vacuum pump during some conditions, and during other conditions the electric motor may drive both the vacuum pump and the coolant pump. Further still, the system may include several coolant pumps driven by separate electric motors that circulate coolant in different coolant loops (e.g. engine and heater core loop, radiator loop, and bypass radiator loops).

Thus, the system of FIG. 1 provides for an engine accessory drive system, comprising: an engine; a vacuum pump; a coolant pump configured to supply liquid coolant to the engine; and an electrically driven motor mechanically coupled to the vacuum pump and the coolant pump. The engine accessory drive system further comprises a controller, the controller including instructions to selectively operate the electrically driven motor during an engine start. The engine accessory drive system includes where the instructions to selectively operate the electrically driven motor during a start include instructions for deactivating the electrically driven pump in response to a state of a battery. The engine accessory drive system includes where the electrically driven motor is coupled to the vacuum pump and the coolant pump via a beltless drive mechanism. The engine accessory drive system includes where the instructions to selectively operate the electrically driven motor during a start include instructions to stop the electrically driven motor during engine cranking. The engine accessory drive system includes further instructions for operating the electrically driven motor at a first speed when an engine temperature is less than a first threshold temperature and when a level of air pressure of a vacuum consumer is greater than a first pressure. The engine accessory drive system includes further instructions for operating the electrically driven motor at a second speed, the second speed greater than the first speed when the engine temperature is greater than the first threshold temperature.

The system of FIG. 1 also provides for an engine accessory drive system, comprising: an engine; a vacuum pump; a coolant pump configured to supply coolant to the engine; and an electrically driven motor coupled to the vacuum pump and the coolant pump; and a controller, the controller including instructions for adjusting a speed of the electrically driven motor in response to a pressure in a vacuum reservoir and a temperature of the engine. The engine accessory drive system includes where the controller includes further instructions for commanding the electrically driven motor to an off state when the temperature of the engine is less than a first temperature during a first engine start, and where the controller includes further instructions for commanding the electrically driven motor to an on state when the temperature of the engine is greater than a second temperature during a second engine start. The engine accessory drive system includes where the controller includes further instructions for operating the electrically driven motor at a first speed when the temperature of the engine is less than a first temperature and when the pressure in the vacuum reservoir is greater than a first pressure. The engine accessory drive system includes where the controller includes further instructions for circulating coolant within the engine when the temperature of the engine is less than a threshold temperature, and where the controller includes further instructions for circulating coolant through the engine and a radiator when the temperature of the engine is greater than the threshold temperature. The engine accessory drive system includes where the threshold temperature varies with engine operating conditions. The engine accessory drive system includes where the threshold temperature is higher for engine loads less than a first engine load threshold, and where the threshold temperature is lower for engine loads less than the first engine load threshold. The engine accessory drive system includes where the controller includes instructions for operating the electrically driven motor when the engine is automatically stopped and when an operator requests cabin heat.

Figure 3:
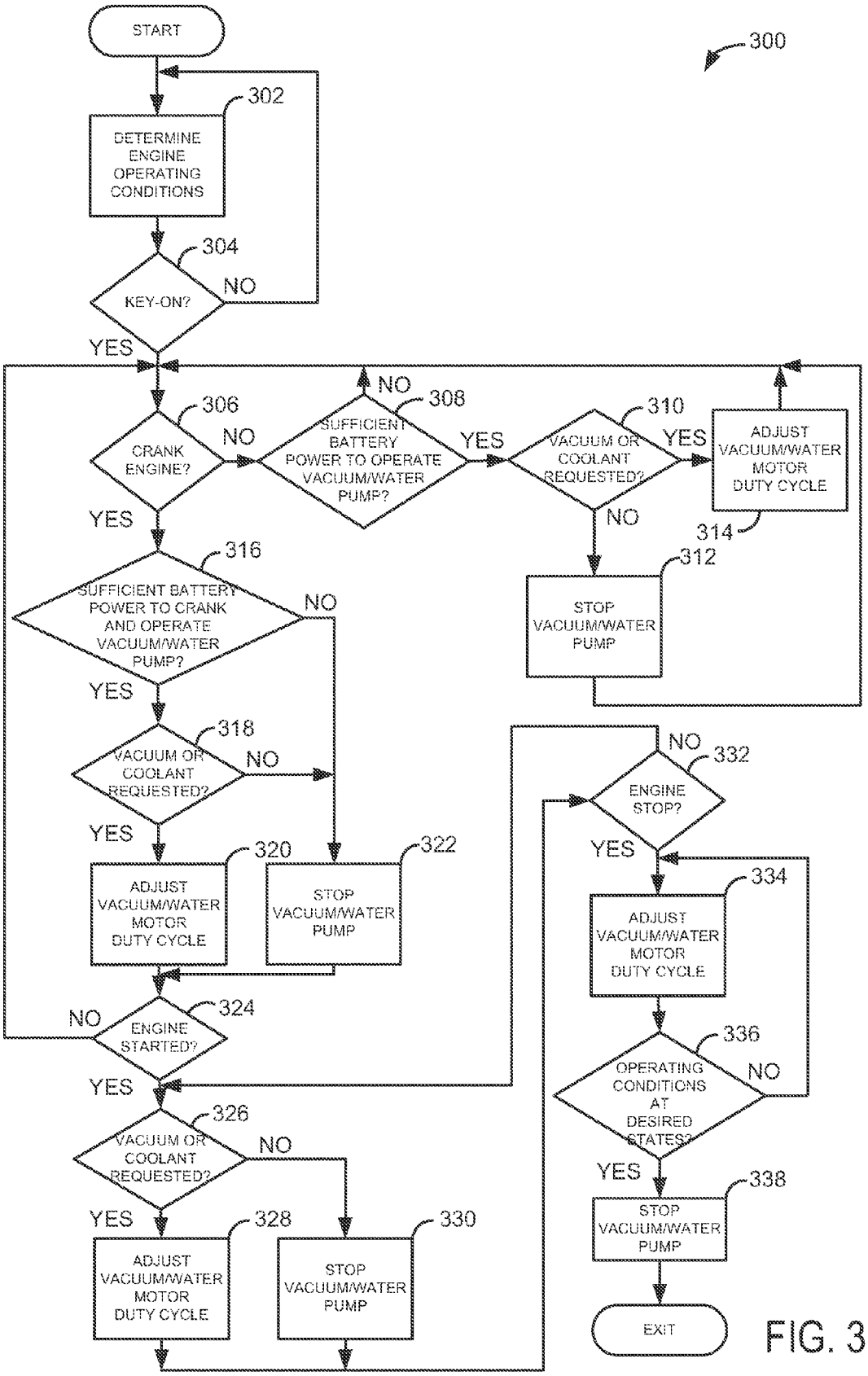
FIG. 3 shows a high level flowchart of a method for operating an electrically driven motor that is coupled to a vacuum pump and a coolant pump.

Referring now to FIG. 2, simulated signals of interest during engine operation are shown. Vertical markers $T_0$-$T_8$ identify particular times of interest during the operating sequence. Similar signals may be observed when the method of FIG. 3 is executed by controller 12 of FIG. 1.

The first plot from the top of FIG. 2 shows engine speed versus time. Time starts at the left side of the plot and increases to the right. Engine speed is at its lowest value at the bottom of the plot and increases to the top of the plot. Horizontal marker 202 represents a desired engine idle speed. Desired engine idle speed can vary with engine operating conditions such as engine temperature and time since engine start.

The second plot from the top of FIG. 2 shows engine load versus time. Time starts at the left side of the plot and increases to the right. Engine load is at its lowest value at the bottom of the plot and increases toward the top of the plot. Engine load may be expressed as a fraction of theoretical cylinder air charge.

The third plot from the top of FIG. 2 shows vacuum reservoir pressure versus time. Time starts at the left side of the plot and increases to the right. Horizontal marker 204 represents a second threshold level of vacuum reservoir pressure. Horizontal marker 206 represents a first threshold level of vacuum reservoir pressure. Vacuum reservoir vacuum is at a higher level of vacuum at the bottom of the plot.

The fourth plot from the top of FIG. 2 shows engine temperature versus time. Time starts at the left side of the plot and increases to the right. Engine coolant is at its lowest value at the bottom of the plot and increases toward the top of the plot.

The fifth plot from the top of FIG. 2 shows an electrically driven vacuum/coolant pump motor control duty cycle command (e.g. vacuum pump 184 of FIG. 1). Time starts at the left side of the plot and increases to the right. The electrically driven vacuum/coolant pump motor control duty cycle command is at a low duty cycle near the bottom of the plot and is at a higher duty cycle near the top of the plot. The duty cycle may be expressed as a percentage of on time relative to off time at a selected motor driving frequency. As the duty cycle increases, the average voltage supplied to the motor over a period of time increases. The speed of the electrically driven vacuum/coolant pump motor increases as the duty cycle increases.

At time $T_0$, engine cranking begins and engine speed is increased to cranking speed (e.g., 200 RPM). Engine load starts at a high level since engine cylinders are initially filled with air during an engine start. Vacuum reservoir pressure is also at a higher level. Vacuum reservoir pressure may increase in response to use of vacuum by a vacuum consumer (e.g., brake booster, waste gate actuator). For example, vacuum reservoir pressure can increase when vehicle brakes are applied and released. Vacuum reservoir pressure can also increase when vacuum is used to operate a turbocharger waste gate or other vacuum operated actuator. Further, vacuum pressure can also increase when air seeps by check valves or other components that are used to maintain vacuum level. On the hand, engine temperature is low indicating the engine is cold started. The electrically driven vacuum/coolant pump motor control duty cycle command is also zero during the engine start. The zero duty cycle indicates that the electrically driven vacuum/coolant pump motor is off. It should be noted that the electrically driven vacuum/coolant pump motor may require a minimum duty cycle before the motor rotates (e.g., 20% duty cycle). Consequently, the water and vacuum pumps may not be pumping in some examples even when there is a duty cycle commanded to the electrically driven vacuum/coolant pump motor. By commanding the electrically driven vacuum/coolant pump motor to an off state more power from the vehicle battery is available to the engine's starter to crank the engine. Further, since the engine is cold and is being cold started the vehicle is in park.

At time $T_1$, engine speed reaches the desired idle speed so it may be determined that the engine is started. Engine load begins to stabilize at engine speed reaches the desired idle speed. The electrically driven vacuum/coolant pump motor is commanded to an on state by commanding a duty cycle greater than zero in response to pressure in the vacuum reservoir exceeding the second threshold level of vacuum reservoir pressure 204. In particular, electrically driven vacuum/coolant pump motor is commanded to a speed, via adjusting a control signal duty cycle, related to the efficiency of the vacuum pump's intake valves. For example, the electrically driven vacuum/coolant pump motor is commanded to a speed where the vacuum pump's intake valves operate to provide the pump's substantially most efficient pumping. Commanding the electrically driven vacuum/coolant pump motor to an on state causes the vacuum pump to begin drawing air from the vacuum reservoir or the vacuum consumer. As a result, the vacuum reservoir pressure begins to decrease at time $T_1$. The engine temperature is low but begins to increase in response to operating the engine.

At time $T_2$, engine speed is greater than idle speed and engine load is greater than engine idle load. Since the electrically driven vacuum/coolant pump motor has been operating since time $T_1$, pressure in the vacuum reservoir has decreased to the first pressure level threshold 206. The electrically driven vacuum/coolant pump motor is commanded to an off state (e.g., zero duty cycle) in response to pressure in the vacuum reservoir reaching the first pressure level threshold 206. The engine temperature continues to increase at time $T_2$.

Between time $T_2$ and $T_3$, vacuum reservoir pressure increases in response to use of vacuum by a vacuum consumer. However, since vacuum reservoir pressure is less than second pressure level threshold 204, electrically driven vacuum/coolant pump motor remains in an off state.

At time $T_3$, the engine is stopped and engine speed goes to zero. Stopping the engine allows air to fill engine cylinder so that engine load increases as indicated by the engine load signal. Vacuum reservoir pressure is greater than first pressure level threshold 206 but less than second pressure level threshold 204 which allows the electrically driven vacuum/coolant pump motor to remain in an off state. Engine temperature briefly increases after engine stop and then begins to decrease.

Between time $T_3$ and $T_4$, the engine is restarted as indicated by increased engine speed. Engine load and temperature also increase in response to restarting the engine. Vacuum reservoir pressure remains substantially constant.

At time $T_4$, engine idle speed is near idle speed and engine load is at a lower level. Engine temperature has increased to a level where it is desirable to begin circulation of engine coolant within the engine without passing engine coolant through a radiator. In some examples, engine coolant can circulate solely within the engine (e.g., coolant is not passed through a radiator or heater core) while in other examples engine coolant is circulated through the engine and the heater core but not through a radiator. By circulating coolant through the heater core it is possible to allow the operator to use some engine heat to heat the vehicle's cabin area. The electrically driven vacuum/coolant pump is activated with a low duty cycle command in response to engine temperature. The low duty cycle command rotates the electrically driven vacuum/coolant pump at a low speed. As a result, coolant begins to circulate through the engine and air is drawn from the vacuum reservoir via the vacuum pump. Thus, at $T_4$, engine temperature rises to a level that causes the electrically driven vacuum/coolant pump to activate even though pressure in the vacuum reservoir is less than the second pressure level threshold 204 where the electrically driven vacuum/coolant pump is activated in response to pressure in the vacuum reservoir.

At time $T_5$, engine speed and load have increased while engine temperature has reached a temperature threshold where the electrically driven vacuum/coolant pump speed is increased to increase circulation of coolant within the engine. Further, a position of a valve (e.g., valve 187 of FIG. 1) is adjusted so that engine coolant is directed through the engine, heater core, and radiator. The valve position is changed so that the temperature of engine coolant exiting the engine is reduced so that engine cooling efficiency increases. In some examples, the duty cycle signal supplied to operate the electrically driven vacuum/coolant pump is increased proportionally to a temperature of the engine rather than at discrete temperatures as shown in FIG. 2. Pressure in the vacuum reservoir is once again below the first pressure level threshold 206 since the vacuum pump is operating and since there is no vacuum being used by a vacuum consumer.

At time $T_6$, engine speed and load have increased while engine coolant has reached another temperature threshold where the electrically driven vacuum/coolant pump speed is increased to increase circulation of coolant within the engine and through the radiator. The coolant control valve (e.g., valve 187 of FIG. 1) remains in a position where engine coolant is directed through the engine, heater core, and radiator.

Between time $T_6$ and $T_7$, engine speed increases and then decreases until the engine is stopped. Engine load also increases, decreases, and then it increases again when the engine is stopped. Pressure in the vacuum reservoir briefly increases in response to use of vacuum by a vacuum consumer and then decreases since the vacuum pump is operated by the electrically driven vacuum/coolant pump. Engine temperature is substantially constant from time $T_6$ until the engine is stopped. Engine temperature increase briefly after the engine is stopped and then begins to decrease.

At time $T_7$, the engine remains stopped as indicated by zero engine speed and a high engine load. Pressure in the vacuum reservoir remains below the first pressure level threshold 206 since the vacuum pump is coupled to the water pump and the rotating electrically driven vacuum/coolant pump motor. In addition, there is no vacuum use by vacuum consumers. Engine temperature reaches a temperature threshold where the electrically driven vacuum/coolant pump speed is decreased to decrease circulation of coolant through the radiator. In particular, the electrically driven pump is deactivated so that the pump does not continue to drain the vehicle battery of charge and so that the engine remains at an elevated temperature as long as possible so that fuel is not used to raise the engine temperature. In one example, a coolant control valve (e.g., valve 187 of FIG. 1) is commanded to a state where engine coolant is free to circulate within the engine, and in some examples the heater core, but not through the radiator. The coolant control valve may be commanded to a position where coolant flows through the engine, heater core, and radiator if the engine is restarted shortly after the engine temperature reaches the temperature threshold where the electrically driven vacuum/coolant pump speed is decreased.

Between time $T_7$ and $T_8$, the engine is restarted. The engine temperature decreases after $T_7$ but increases after the engine is restarted. Pressure in the vacuum reservoir remains substantially constant. The electrically driven vacuum/coolant pump remains in an off state as engine temperature decreases and while pressure in the vacuum reservoir remains below the second threshold level of vacuum reservoir pressure 204.

At time $T_8$, engine speed and load have stabilized to levels at engine idle speed. Pressure in the vacuum reservoir remains substantially constant. Engine temperature has increased to a level where it is desirable to operate the electrically driven vacuum/coolant pump motor. Accordingly, the electrically driven vacuum/coolant pump motor is commanded to an on state by increasing a duty cycle of the vacuum/coolant pump command signal. Thus, coolant begins to circulate through the engine at time $T_8$ in response to an engine temperature.

It should be noted that if the vacuum pump and coolant pump are mechanically coupled without a clutching system, the losses of the vacuum pump can be reduced by operating the vacuum pump where the vacuum pump inlet pressure is open to atmospheric pressure (or boost air) or where the vacuum pump inlet is closed. Thus, to improve system efficiency the vacuum pump can be set to a condition where the inlet is open to atmosphere or closed. As such, a valve may be placed between vacuum pump 184 and vacuum reservoir 139 for the system shown in FIG. 1. The valve may be controlled by controller 12 such that it only opens when pressure in the vacuum reservoir 139 is greater than a second predetermined amount. The valve is closed when pressure in vacuum reservoir is less than a first predetermined amount. In this way, the vacuum pump inlet may be put in selective fluid communication with vacuum reservoir 139 to increase system efficiency.

Thus, FIG. 2 shows signals of interest during one example engine operating sequence. It can be observed from the signals of FIG. 2 that an electrically driven vacuum/coolant pump motor can provide vacuum and circulate engine coolant so that vacuum and engine cooling are provided when needed even though the vacuum pump and the water pump are coupled together. Further, it can be observed that the electrically driven vacuum/coolant pump can be deactivated when vacuum and engine coolant circulation are not requires so that battery charge may be conserved. Further still, it can be observed that the electrically driven vacuum/coolant pump can be operated so that the engine may be stopped even though there may be a demand for additional vacuum or engine cooling since the electrically driven vacuum/coolant pump can operate independent of engine operation.

Referring now to FIG. 3, a high level flowchart for adjusting operation of a vacuum control valve is shown. The method of FIG. 3 is executable by instructions of controller 12 of FIG. 1.

At 302, method 300 determines engine operating conditions. Engine operating conditions include but are not limited to engine speed, engine load, vacuum reservoir pressure, engine intake manifold pressure, intake throttle position, brake actuator position, engine temperature, and desired engine torque. Method 300 proceeds to 304 after engine operating conditions are determined.

At 304, method 300 judges whether or not ignition key-on is present. A key-on condition may be indicated by an assertion of a switch such as an ignition switch or a start engine button. The key-on condition does not have to include engine cranking. However, the key-on condition may be indicative of a future intent to start the vehicle's engine. If method 300 judges no key-on is indicated, method 300 returns to 302. Otherwise, method 300 proceeds to 306.

At 306, method 300 judges whether or not there is a request to crank the engine. An engine crank request may be initiated by a key or other input to a controller, and the engine may be cranked via a starter motor or via an auxiliary motive device. If method 300 judges that there is an engine cranking request, method 300 proceeds to 316. Otherwise, method 300 proceeds to 308.

At 308, method 300 judges whether or not there is sufficient battery power to operate the electrically driven vacuum/coolant motor to mechanically drive the vacuum pump and the water pump. In one example, method 300 judges whether or not there is sufficient battery power to operate the electrically driven vacuum/coolant motor based on battery voltage. In other examples, method 300 judges whether or not there is sufficient battery power to operate the electrically driven vacuum/coolant motor based on an estimated battery state of charge. If method 300 judges that there is sufficient battery power to operate the electrically driven vacuum/coolant motor, method 300 proceeds to 310. Otherwise, method 300 returns to 306. In this way, method 300 may conserve battery power for starting the engine rather than operating the electrically driven vacuum/coolant motor.

At 310, method 300 judges whether or not a request for vacuum or engine coolant has been initiated. A vacuum or an engine coolant request may be initiated in response to a pressure of a vacuum reservoir greater than a predetermined threshold pressure or an engine temperature greater than a threshold engine temperature. In another example, a vacuum or engine coolant request may be initiated by activation or deactivation of a device of a vehicle. For example, a vacuum or engine coolant request may be initiated in response to activation or deactivation of a brake pedal. The engine coolant request can indicate that it is desirable for coolant circulation within the engine. During cold engine starts, the engine coolant request may be absent; however, the engine coolant request may be asserted as engine temperature increases as shown in FIG. 2. If a vacuum or engine coolant request is requested, method 300 proceeds to 314. Otherwise, method 300 proceeds to 312.

At 314, method 300 adjusts the command to the electrically driven vacuum/coolant motor and starts the electrically driven vacuum/coolant motor so that the vacuum pump and the engine coolant pump rotate. In one example, the electrically driven vacuum/coolant motor may be activated via an electrical command such as activating a voltage supplied to the motor at a selected duty cycle. Air begins to be evacuated from a vacuum reservoir and the vacuum system when the electrically driven vacuum/coolant motor is started since it is coupled to the vacuum pump. In addition, since the electrically driven vacuum/coolant motor is coupled to the engine coolant pump, engine coolant circulates in the engine.

In one example, method 300 activates the electrically driven vacuum/coolant motor and adjusts the duty cycle of a command signal supplied to the electrically driven vacuum/coolant motor in the following manner. If the electrically driven vacuum/coolant motor is activated in response to a vacuum request the duty cycle of a command signal may be set to a fixed value or a value that varies with operating conditions. In particular, electrically driven vacuum/coolant pump motor is commanded to a speed, via adjusting a control signal duty cycle, related to the efficiency of the vacuum pump's intake valves. For example, the electrically driven vacuum/coolant pump motor is commanded to a speed where the vacuum pump's intake valves operate to provide the pump's substantially most efficient pumping work.

On the other hand, if the electrically driven vacuum/coolant motor is activated in response to an engine coolant request, the engine speed of the electrically driven vacuum/coolant motor may be set based on one or more variables that index an empirically determined desired motor speed for the electrically driven vacuum/coolant motor. In one example, the duty cycle command signal may be based on engine speed and engine load. In another example, the duty cycle command signal may be based on a speed of a fan cooling a radiator. Further, the duty cycle command signal can be adjusted in response to an operator request for cabin heat. For example, if an operator sets a desired cabin temperature to a temperature and the actual cabin temperature is less than the desired cabin temperature, the duty cycle may be commanded to a value that makes the electrically driven vacuum/coolant motor circulate coolant through the engine and heater core.

It should be noted in some examples that a position of a coolant valve (e.g., valve 187) may also be adjusted in response to engine temperature. In some examples, the coolant valve may change state in response to engine coolant temperature. In other examples, a controller (e.g., controller 12 of FIG. 1) may change the state of the coolant valve in response to operating conditions. For example, if engine temperature is less than a threshold temperature, the coolant valve can be commanded to a first position where engine coolant circulates in the engine. Alternatively, engine coolant can be circulated in the engine and a heater core when the coolant valve is in a first position. If engine temperature is greater than the threshold temperature, the coolant valve can be commanded to a second position where engine coolant circulates through the engine, heater core, and radiator.

In this way, the duty cycle of a command for operating an electrically driven vacuum/coolant motor can be controlled taking vacuum and engine temperature into consideration. For example, an electrically driven vacuum/coolant motor may be activated during a first engine start when the temperature of the engine is greater than a first threshold temperature. The electrically driven vacuum/coolant motor may be deactivated during a second engine start when the temperature of the engine is less than the first temperature. In another example, the electrically driven vacuum/coolant motor can be operated at a first speed to circulate engine coolant in an engine and to provide vacuum when a temperature of the engine is less than a first threshold temperature. The electrically driven vacuum/coolant motor can be operated at a second speed to circulate engine coolant in the engine and to provide vacuum when a temperature of the engine is greater than the first temperature. Method 300 returns to 306 after the electrically driven vacuum/coolant motor is started.

At 312, the electrically driven vacuum/coolant motor may be shut off or deactivated by commanding the control signal duty cycle to zero. Deactivating the electrically driven vacuum/coolant motor stops air from being drawn from the vacuum reservoir by the vacuum pump and reduces coolant circulation within the engine. Method 300 returns to 306 after the electrically driven vacuum/coolant motor is deactivated.

At 316, method 300 judges whether or not there is sufficient battery power to crank the engine and operate the electrically driven vacuum/coolant motor. In one example, method may allow the electrically driven vacuum/coolant motor to operate as long as the battery voltage is greater than a predetermined threshold voltage. If the battery voltage is less than the predetermined threshold voltage before or during engine cranking, the electrically driven vacuum/coolant motor may be commanded off. In other examples, method 300 may judge whether or not there is sufficient battery power to crank the engine and operate the electrically driven vacuum/coolant motor in response to an estimated battery state of charge. If it is judged that there is sufficient battery power to crank the engine and operate the vacuum pump, method 300 proceeds to 318. Otherwise, method 300 proceeds to 322.

At 318, method 300 judges whether or not vacuum or engine coolant is requested. Method 300 judges whether or not vacuum or engine coolant is requested at 318 in the same manner as described at 310. If vacuum or engine coolant is requested, method 300 proceeds to 320. Otherwise, method 300 proceeds to 322.

At 320, method 300 adjusts the command to the electrically driven vacuum/coolant motor and adjusts the command signal duty cycle. As described at 314, the electrically driven vacuum/coolant motor can be operated at different speeds and can be activated and deactivated according to the requirement of the vacuum system and engine temperature. Method 300 adjusts the duty cycle command signal (or other type of command signal, e.g., voltage command or digital command) as described at 314 and then proceeds to 324.

At 322, the electrically driven vacuum/coolant motor may be shut off or deactivated by adjusting the duty cycle command to zero or by opening a switch or a relay. Deactivating the electrically driven vacuum/coolant motor deactivated the vacuum and coolant pumps. Method 300 proceeds to 324 after the electrically driven vacuum/coolant motor is deactivated.

At 324, method 300 judges whether or not the engine is started. The engine may be judged to be started after the engine reaches a predetermined engine starting speed. For example, the engine may be determined to be started after a desired engine idle speed is exceeded. If method 300 judges that the engine is started, method 300 proceeds to 326. Otherwise, method 300 returns to 306.

At 326, method 300 judges whether or not vacuum or coolant is requested. As discussed at 318, a vacuum request may be initiated in response to a pressure of a vacuum reservoir greater than a predetermined threshold pressure. On the other hand, a coolant request may be initiated in response to an engine temperature greater than a threshold engine temperature. If vacuum or coolant is requested, method 300 proceeds to 328. Otherwise, method 300 proceeds to 330.

At 328, method 300 adjusts the command to the electrically driven vacuum/coolant motor and adjusts the command signal duty cycle. As described at 314 and 320, the electrically driven vacuum/coolant motor can be operated at different speeds and can be activated and deactivated according to the requirement of the vacuum system and engine temperature. Method 300 adjusts the duty cycle command signal (or other type of command signal, e.g., voltage command or digital command) as described at 314 and proceeds to 332.

At 330, the electrically driven vacuum/coolant motor may be shut off or deactivated by commanding the duty cycle command to zero or by opening a switch or a relay. Method 300 proceeds to 332 after the electrically driven vacuum/coolant motor is deactivated.

At 332, method 300 judges whether or not there is a request to stop the engine. The request may be initiated by an operator or by a system of the vehicle (e.g., a hybrid vehicle controller). If an engine stop request is not present, method 300 returns to 326. Otherwise, method 300 proceeds to 334.

At 334, method 300 adjusts the command to the electrically driven vacuum/coolant motor and adjusts the command signal duty cycle. As described at 314 and 320, the electrically driven vacuum/coolant motor can be operated at different speeds and can be activated and deactivated according to the requirement of the vacuum system and engine temperature. Method 300 adjusts the duty cycle command signal (or other type of command signal, e.g., voltage command or digital command) as described at 314 and proceeds to 332. However, method 300 may include specific commands for adjusting the electrically driven vacuum/coolant motor during stopping conditions. For example, as discussed in FIG. 2, the electrically driven vacuum/coolant motor can be commanded to a speed until engine temperature reaches a threshold temperature and then the vacuum/coolant motor can be commanded off to conserve battery charge. In other examples, the electrically driven vacuum/coolant motor may be commanded to a plurality of speeds related to engine temperature after an engine stop. In this way, the electrically driven vacuum/coolant motor may be controlled for a variety of operating conditions.

At 336, method 300 judges whether or not operating conditions are at a desired state. For example, method 300 may judge it desirable to stop the electrically driven vacuum/coolant motor if engine temperature is less than a threshold temperature. In this way, the electrically driven vacuum/coolant motor may continue to operate as long as engine temperature is high. In another example, method 300 may judge it desirable to deactivate the electrically driven vacuum/coolant motor if the engine stops and battery state of charge is less than a threshold level. If method 300 judges that operating conditions are at desired states, method 300 proceeds to 338. Otherwise, method 300 returns to 334.

At 338, method 300 stops the electrically driven vacuum/coolant motor. The motor may be shut off or deactivated by commanding a duty cycle to zero or by opening a switch or a relay. Method 300 proceeds to exit after the electrically driven vacuum/coolant motor is deactivated.

In this way, the method of FIG. 3 provides for adjusting the speed of an electrically driven motor coupled to a vacuum pump and a coolant pump to account for different priorities between vacuum pumps and coolant pumps. For example, if vacuum is requested when engine temperature is low the electrically driven vacuum/coolant motor coupled to the vacuum pump and coolant pump can be operated at a low speed. By operating the vacuum pump at a low speed the vacuum pump may be operated efficiently. However, if addition engine cooling is requested via a cooling request the electrically driven vacuum/coolant motor can be operated at a higher speed to improve engine cooling.

Thus, the method of FIG. 6 provides for a method for providing vacuum and coolant, comprising: mechanically coupling a coolant pump and a vacuum pump to an electrically driven motor, the coolant pump configured to provide coolant to an engine, the vacuum pump configured to provide vacuum to a vacuum consumer; and providing vacuum and circulating coolant via selectively operating the electrically driven motor. The method further comprises circulating the coolant and providing vacuum to the vacuum consumer via operating the electrically driven motor at a first speed when a temperature of an engine is less than a first threshold temperature. The method further comprises circulating the coolant and providing vacuum to the vacuum consumer via operating the electrically driven motor at a second speed when the temperature of the engine is greater than the first threshold temperature. The method includes where the electrically driven motor is activated during a first engine start when the temperature of the engine is greater than the first threshold temperature and where the electrically driven motor is deactivated during a second engine start when the temperature of the engine is less than the first threshold temperature. The method further comprises circulating the coolant to a heater core via operating the electrically driven motor at the first speed after an automatic stop and in response to an operator request for cabin heat. The method includes where the first speed is a speed where the vacuum pump is substantially at its highest pumping efficiency.

As will be appreciated by one of ordinary skill in the art, the method described in FIG. 3 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, single cylinder, I2, I3, I4, I5, V6, V8, V10, V12 and V16 engines operating in natural gas, gasoline, diesel, or alternative fuel configurations could use the present description to advantage.

The invention claimed is:

1. An engine accessory drive system, comprising:

an engine;

a vacuum pump that draws engine oil for lubrication or sealing and exhausts pumped air to an interior region of the engine;

a coolant pump configured to supply liquid coolant to the engine;

an electrically driven motor mechanically coupled to the vacuum pump and the coolant pump; and a controller including instructions to selectively operate the electrically driven motor during or prior to an engine start, and for operating the electrically driven motor at a first speed when an engine temperature is less than a first threshold temperature and when a level of air pressure of a vacuum consumer is greater than a first pressure.

2. The engine accessory drive system of claim 1, where the instructions to selectively operate the electrically driven motor during a start include instructions for deactivating the electrically driven motor in response to a state of a battery.

3. The engine accessory drive system of claim 1, where the electrically driven motor is coupled to the vacuum pump and the coolant pump via a beltless drive mechanism, and further comprising an engine driven coolant pump.

4. The engine accessory drive system of claim 1, where the instructions to selectively operate the electrically driven motor during a start include instructions to stop the electrically driven motor during engine cranking, and where the engine or the electrically driven motor may selectively drive the vacuum pump or the coolant pump.

5. The engine accessory drive system of claim 1, including further instructions for operating the electrically driven motor at a second speed, the second speed greater than the first speed when the engine temperature is greater than the first threshold temperature.

6. An engine accessory drive system, comprising:

an engine;

a vacuum pump;

a coolant pump configured to supply coolant to the engine; and an electrically driven motor mechanically coupled to the vacuum pump and the coolant pump; and a controller, the controller including instructions for adjusting a speed of the electrically driven motor in response to a pressure in a vacuum reservoir and a temperature of the engine.

7. The engine accessory drive system of claim 6, where the controller includes further instructions for commanding the electrically driven motor to an off state when the temperature of the engine is less than a first temperature during a first engine start, and where the controller includes further instructions for commanding the electrically driven motor to an on state when the temperature of the engine is greater than a second temperature during a second engine start.

8. The engine accessory drive system of claim 6, where the controller includes further instructions for operating the electrically driven motor at a first speed when the temperature of the engine is less than a first temperature and when the pressure in the vacuum reservoir is greater than a first pressure.

9. The engine accessory drive system of claim 6, where the controller includes further instructions for circulating coolant within the engine when the temperature of the engine is less than a threshold temperature, and where the controller includes further instructions for circulating coolant through the engine and a radioator when the temperature of the engine is greater than the threshold temperature.

10. The engine accessory drive system of claim 9, where the threshold temperature varies with engine operating conditions.

11. The engine accessory drive system of claim 10, where the threshold temperature is higher for engine loads less than a first engine load threshold, and where the threshold temperature is lower for engine loads less than the first engine load threshold.

12. The engine accessory drive system of claim 6, where the controller includes instructions for operating the electrically driven motor when the engine is automatically stopped and when an operator requests cabin heat, and further comprising at least one additional coolant pump.

13. A method for providing vacuum and coolant, comprising:

mechanically coupling a coolant pump and a vacuum pump to an electrically driven motor, the coolant pump configured to provide coolant to an engine, the vacuum pump configured to provide vacuum to a vacuum consumer;

providing vacuum and circulating coolant via selectively operating the electrically driven motor;

circulating the coolant and providing vacuum to the vacuum consumer via operating the electrically driven motor at a first speed when a temperature of the engine is less than a first threshold temperature; and circulating the coolant and providing vacuum to the vacuum consumer via operating the electrically driven motor at a second speed when the temperature of the engine is greater than the first threshold temperature, where the electrically driven motor is activated during a first engine start when the temperature of the engine is greater than the first threshold temperature and where the electrically driven motor is deactivated during a second engine start when the temperature of the engine is less than the first threshold temperature.

14. The method of claim 13, further comprising circulating the coolant to a heater core via operating the electrically driven motor at the first speed after an automatic stop and in response to an operator request for cabin heat.

* * * * *